US008764484B2

(12) United States Patent
Zhang et al.

(10) Patent No.: US 8,764,484 B2
(45) Date of Patent: Jul. 1, 2014

(54) ELECTRICAL CONNECTOR WITH MULTILAYER SURFACE TREATMENT AND METHOD FOR FABRICATING THE SAME

(75) Inventors: Wei-De Zhang, Shenzhen (CN); Peng-Cheng Wu, Shenzhen (CN)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 110 days.

(21) Appl. No.: 13/562,319

(22) Filed: Jul. 31, 2012

(65) Prior Publication Data

US 2013/0164982 A1 Jun. 27, 2013

(30) Foreign Application Priority Data

Dec. 23, 2011 (CN) ..... 2011 1 0437610

(51) Int. Cl.
*H01R 13/648* (2006.01)

(52) U.S. Cl.
USPC ..... 439/607.36

(58) Field of Classification Search
USPC ..... 439/607.36, 607.35, 607.4, 886, 892; 200/269
See application file for complete search history.

(56) References Cited

U.S. PATENT DOCUMENTS

| | | | | | |
|---|---|---|---|---|---|
| 1,862,128 | A | * | 6/1932 | Wermine | 439/460 |
| 2,337,247 | A | * | 12/1943 | Kepler | 72/54 |
| 2,590,559 | A | * | 3/1952 | Miller | 310/71 |
| 2,855,578 | A | * | 10/1958 | Hirsh | 439/38 |
| 2,878,302 | A | * | 3/1959 | Perkins | 174/73.1 |
| 3,046,647 | A | * | 7/1962 | Carstens | 228/157 |
| 3,435,439 | A | * | 3/1969 | Nakamura | 365/56 |
| 3,781,764 | A | * | 12/1973 | Johnson | 439/272 |
| 4,239,838 | A | * | 12/1980 | Miller et al. | 429/104 |
| 4,426,248 | A | * | 1/1984 | Jackson | 216/108 |
| 4,490,184 | A | * | 12/1984 | Forcht et al. | 148/275 |
| 4,601,958 | A | * | 7/1986 | Levine | 428/672 |
| 4,707,724 | A | * | 11/1987 | Suzuki et al. | 257/677 |
| 4,722,137 | A | * | 2/1988 | Ellenberger | 29/841 |
| 4,765,528 | A | * | 8/1988 | Sekibata et al. | 228/123.1 |
| 4,840,547 | A | * | 6/1989 | Fry | 417/422 |
| 4,968,389 | A | * | 11/1990 | Satoh et al. | 205/106 |
| 5,295,844 | A | * | 3/1994 | Koshikawa et al. | 439/138 |
| 5,501,615 | A | * | 3/1996 | Inaba et al. | 439/578 |
| 5,556,023 | A | * | 9/1996 | Kuramoto et al. | 228/248.1 |
| 5,628,636 | A | * | 5/1997 | Ollivier | 439/70 |
| 5,713,997 | A | * | 2/1998 | Kuramoto et al. | 106/287.18 |

(Continued)

FOREIGN PATENT DOCUMENTS

| | | |
|---|---|---|
| TW | M365565 | 9/2009 |
| TW | M420917 | 1/2012 |

*Primary Examiner* — Amy Cohen Johnson
*Assistant Examiner* — Vladimir Imas
(74) *Attorney, Agent, or Firm* — Wei Te Chung; Ming Chieh Chang

(57) ABSTRACT

An electrical connector includes an insulative housing (3), a number of contacts (4) retained in the insulative housing (3) and a metallic shell (1) enclosing the insulative housing (3). The metallic shell (1) includes a number of peripheral walls and a soldering tab (15) extending therefrom. Each of the soldering tab (15) and the peripheral walls includes an intermediate layer (20), a first plating layer (21), a second plating layer (22) and a third plating layer (23). The third plating layer (23) covers both inner and outer sides of the second plating layer (22) of the peripheral walls for enhancing anti-wear properties while leaving the second plating layer (22) of the soldering tab (15) uncoated for wetting. Besides, a method of surface treatment of the metallic shell (1) is also disclosed.

17 Claims, 11 Drawing Sheets

(56) References Cited

U.S. PATENT DOCUMENTS

| | | | | |
|---|---|---|---|---|
| 5,929,517 | A * | 7/1999 | Distefano et al. | 257/707 |
| 5,993,258 | A * | 11/1999 | Matsunuma et al. | 439/607.04 |
| 6,168,454 | B1 * | 1/2001 | Dzwonczyk | 439/381 |
| 6,207,298 | B1 * | 3/2001 | Fukui | 428/646 |
| 6,217,737 | B1 | 4/2001 | Baumann | |
| 6,368,167 | B1 * | 4/2002 | Ma et al. | 439/886 |
| 6,552,275 | B2 * | 4/2003 | Fartash et al. | 174/260 |
| 6,984,148 | B1 * | 1/2006 | Nanda et al. | 439/564 |
| 7,261,596 | B2 * | 8/2007 | Akaike et al. | 439/607.01 |
| 7,552,532 | B2 * | 6/2009 | Stelzl et al. | 29/855 |
| 7,973,246 | B2 * | 7/2011 | Kuwajima | 174/261 |
| 8,241,046 | B2 * | 8/2012 | Takagi et al. | 439/83 |
| 8,377,149 | B2 * | 2/2013 | Dopp et al. | 29/25.03 |
| 2012/0295481 | A1 * | 11/2012 | Zhang | 439/607.22 |

* cited by examiner

ELECTRICAL CONNECTOR WITH MULTILAYER SURFACE TREATMENT AND METHOD FOR FABRICATING THE SAME

BACKGROUND OF THE INVENTION

1. Field of the Invention

The present disclosure relates to an electrical connector, and more particularly to an electrical connector having a metallic shell of multilayer surface treatment and a method for making such metallic shell.

2. Description of Related Art

Conventional electronic devices, such as mobile phones, usually have black appearance. In order to match with such color, electrical connectors outwardly exposed on such black electronic devices should have black surface treatment.

Nowadays, in industry, back surface treatment technologies usually include black electrophoretic coating treatment, directly plating black nickel treatment and directly plating black titanium treatment. Take the black electrophoretic coating treatment for example, in such treatment, an insulative layer is formed on peripheral sides of a metallic shell of an electrical connector. However, such insulative layer can not meet electrical conduction requirement and mostly importantly, its anti-wear capability is poor. In a word, the metallic shell treated under conventional back surface treatment technologies exists poor soldering capability and poor anti-wear capability and is not suitable for being applied in current electronic devices.

Hence, it is desirable to provide an electrical connector with improved surface treatment and a method for making the same.

BRIEF SUMMARY OF THE INVENTION

The present disclosure provides an electrical connector including an insulative housing, a plurality of contacts retained in the insulative housing and a metallic shell enclosing the insulative housing. The metallic shell includes a plurality of peripheral walls jointly forming a receiving cavity and a soldering tab extending from one of the peripheral walls to be soldered to a circuit board. Each of the soldering tab and the peripheral walls includes an intermediate layer made of a first material, a first plating layer made of a second material, a second plating layer made of a third material and a third plating layer made of a fourth material. The third material is of robust soldering capability and the fourth material is of robust anti-wear capability. The first plating layer covers both inner and outer sides of the intermediate layer of the soldering tab and the peripheral walls. The second plating layer covers both inner and outer sides of the first layer of the soldering tab and the peripheral walls. The third plating layer covers both inner and outer sides of the second layer of the peripheral walls for enhancing anti-wear properties while leaving the second layer of the soldering tab uncoated for wetting.

Besides, the present disclosure provides a method for surface treatment of a metallic shell of an electrical connector. The method includes the steps of:

S1) providing a metallic shell stamped from a first material, the metallic shell being provided with a plurality of peripheral walls and a soldering tab extending from one of the peripheral walls to be soldered to a circuit board;

S2) plating a first plating layer of a second material on both inner and outer sides of the soldering tab and the peripheral walls;

S3) plating a second plating layer of a third material on both inner and outer sides of the first plating layer of the soldering tab and the peripheral walls, the third material being of robust soldering capability;

S4) shielding the soldering tab so as to be uncoated in subsequent steps;

S5) plating a third plating layer of a fourth material on both inner and outer sides of the second plating layer of the peripheral walls, the fourth material being of robust anti-wear capability; and S6) cleaning the foregoing shielded soldering tab to expose the second plating layer thereon.

The foregoing has outlined rather broadly the features and technical advantages of the present disclosure in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present disclosure, and the advantages thereof, reference is now made to the following descriptions taken in conjunction with the accompanying drawings, in which.

DETAILED DESCRIPTION OF THE PREFERRED EMBODIMENTS

Figure 1:
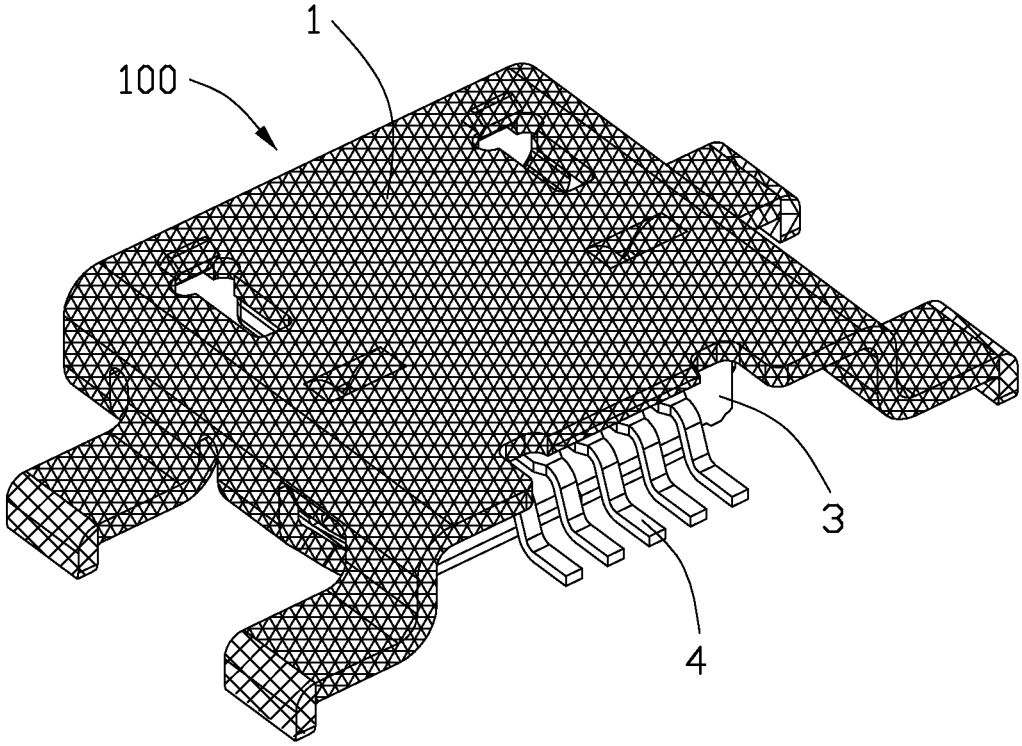
FIG. 1 is a perspective view of an electrical connector in accordance with an illustrated embodiment of the present disclosure.
Figure 2:
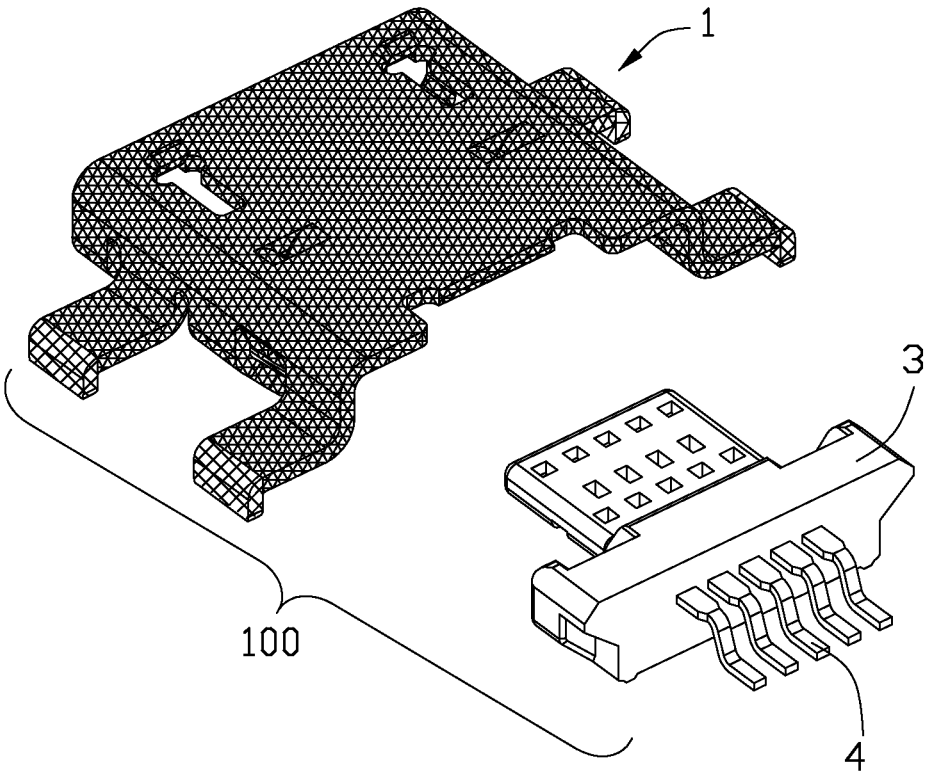
FIG. 2 is a partly exploded view of the electrical connector as shown in FIG. 1.
Figure 3:
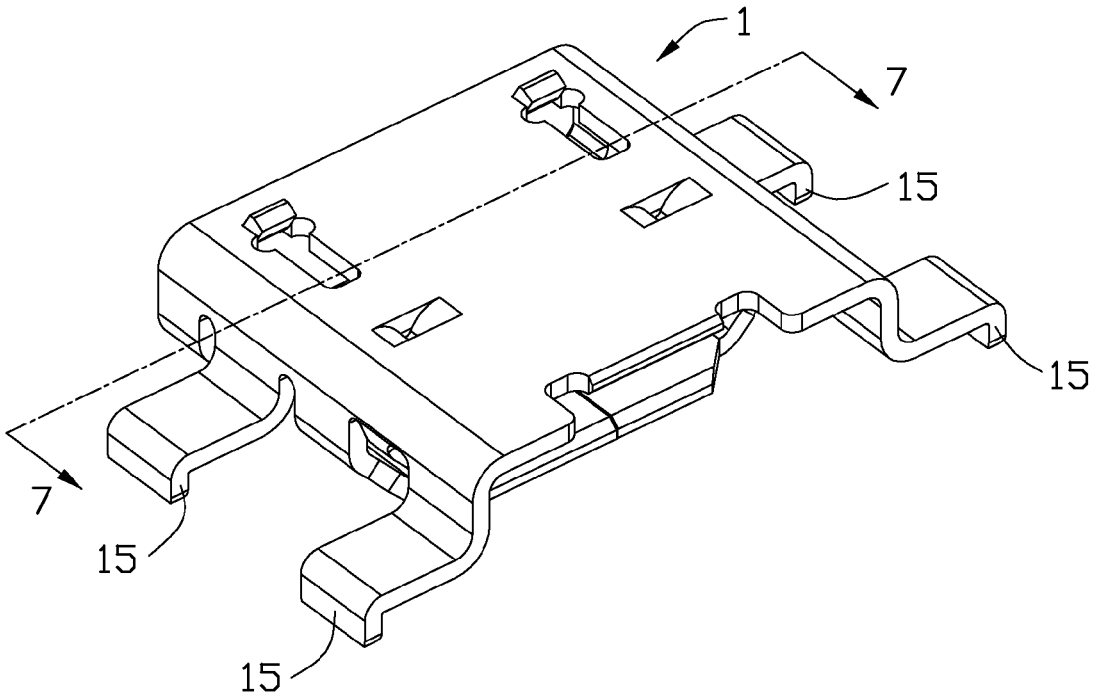
FIG. 3 is a perspective view of a metallic shell of the electrical connector after stamping.
Figure 4:
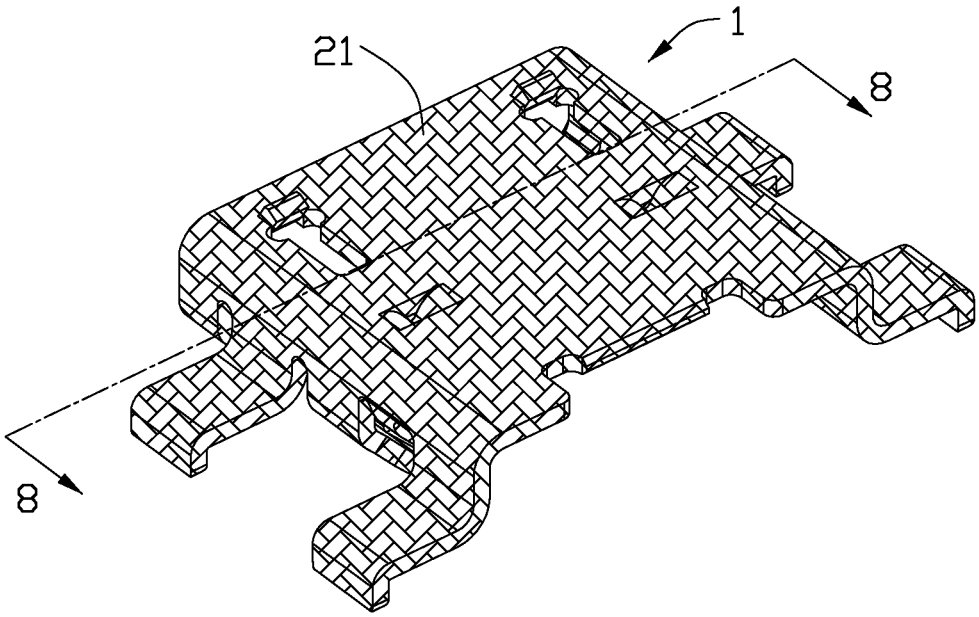
FIG. 4 is a perspective view of the metallic shell after being plated with a first plating layer.
Figure 5:
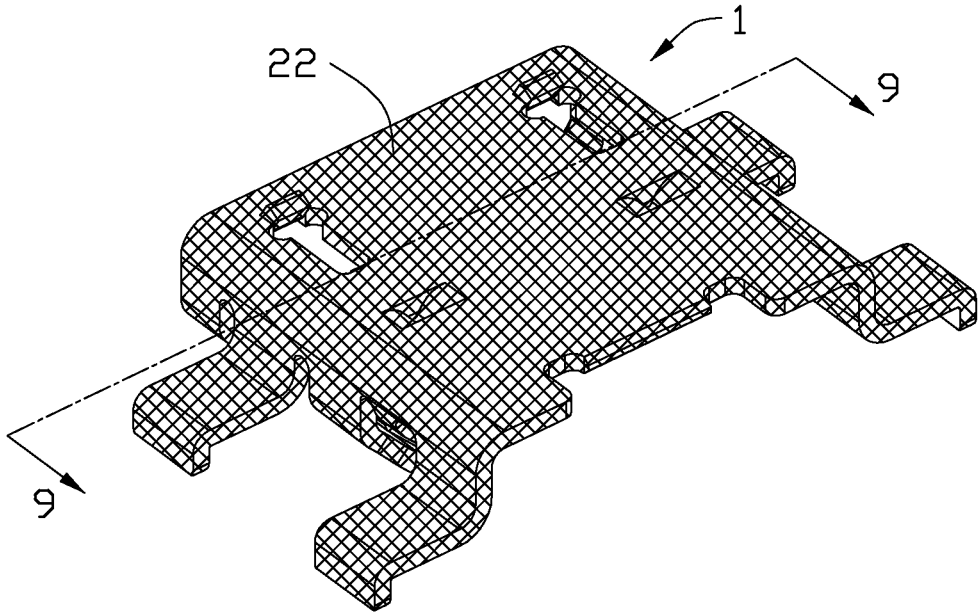
FIG. 5 is a perspective view of the metallic shell after being plated with a second plating layer.

Reference will now be made to the drawing figures to describe the preferred embodiment of the present disclosure in detail. As shown in FIGS. 1 and 2, the illustrated embodiment of the present disclosure discloses an electrical connector 100 including an insulative housing 3, a plurality of contacts 4 retained in the insulative housing 3 and a metallic shell 1 enclosing the insulative housing 3. The electrical connector 100 is a standard Micro USB connector and is soldered to a circuit board (not shown) of an electronic device (such as a mobile phone). The electrical connector 100 is usually exposed to the electronic device and functions as a data-transmission port or a charger port.

Figure 6:
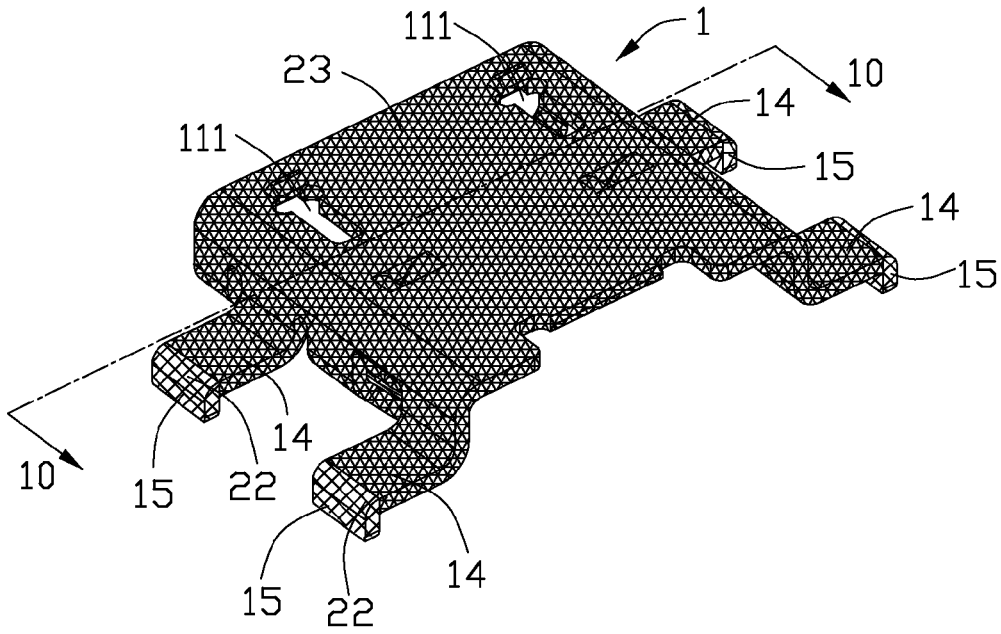
FIG. 6 is a perspective view of the metallic shell after being plated with a third plating layer.
Figure 7:
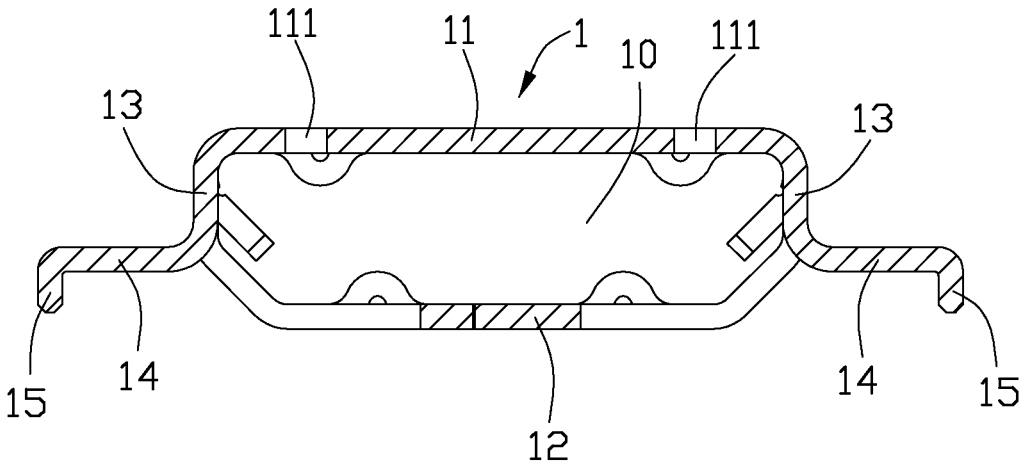
FIG. 7 is a cross-sectional view of the metallic shell taken along line 7-7 of FIG. 3.
Figure 8:
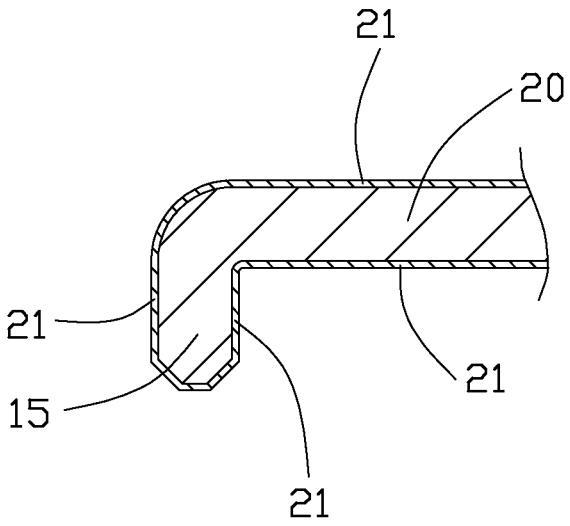
FIG. 8 is partly enlarged cross-sectional view of the metallic shell taken along line 8-8 of FIG. 4 with right side thereof omitted.
Figure 9:
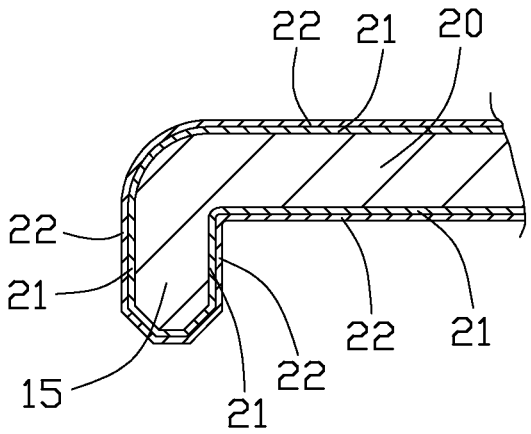
FIG. 9 is partly enlarged cross-sectional view of the metallic shell taken along line 9-9 of FIG. 5 with right side thereof omitted.

Referring to FIGS. 6 and 7, the metallic shell 1 includes a top wall 11, a bottom wall 12, a pair of side walls 13 connecting the top wall 11 and the bottom wall 12, a plurality of extending portions 14 horizontally extending from the side walls 13, and a plurality soldering tabs 15 located at distal ends of the extending portions 14. Each soldering tab 15 extends along a vertical direction for being inserted through the circuit board before getting soldered. The top wall 11, the bottom 12 and the pair of side walls 13 jointly form a receiving cavity 10 for receiving a plug connector (not shown). Each of the top wall 11, the bottom 12 and the pair of side walls 13 can be regarded as a peripheral wall. The top wall 11 defines a pair of locking holes 111 in communication with the receiving cavity 10.

Figure 10:
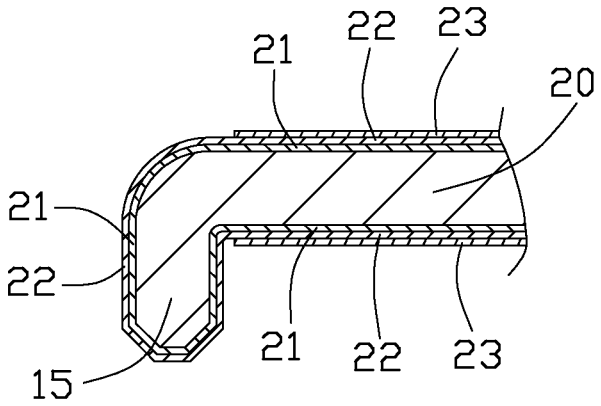
FIG. 10 is partly enlarged cross-sectional view of the metallic shell taken along line 10-10 of FIG. 6 with right side thereof omitted.
Figure 11:
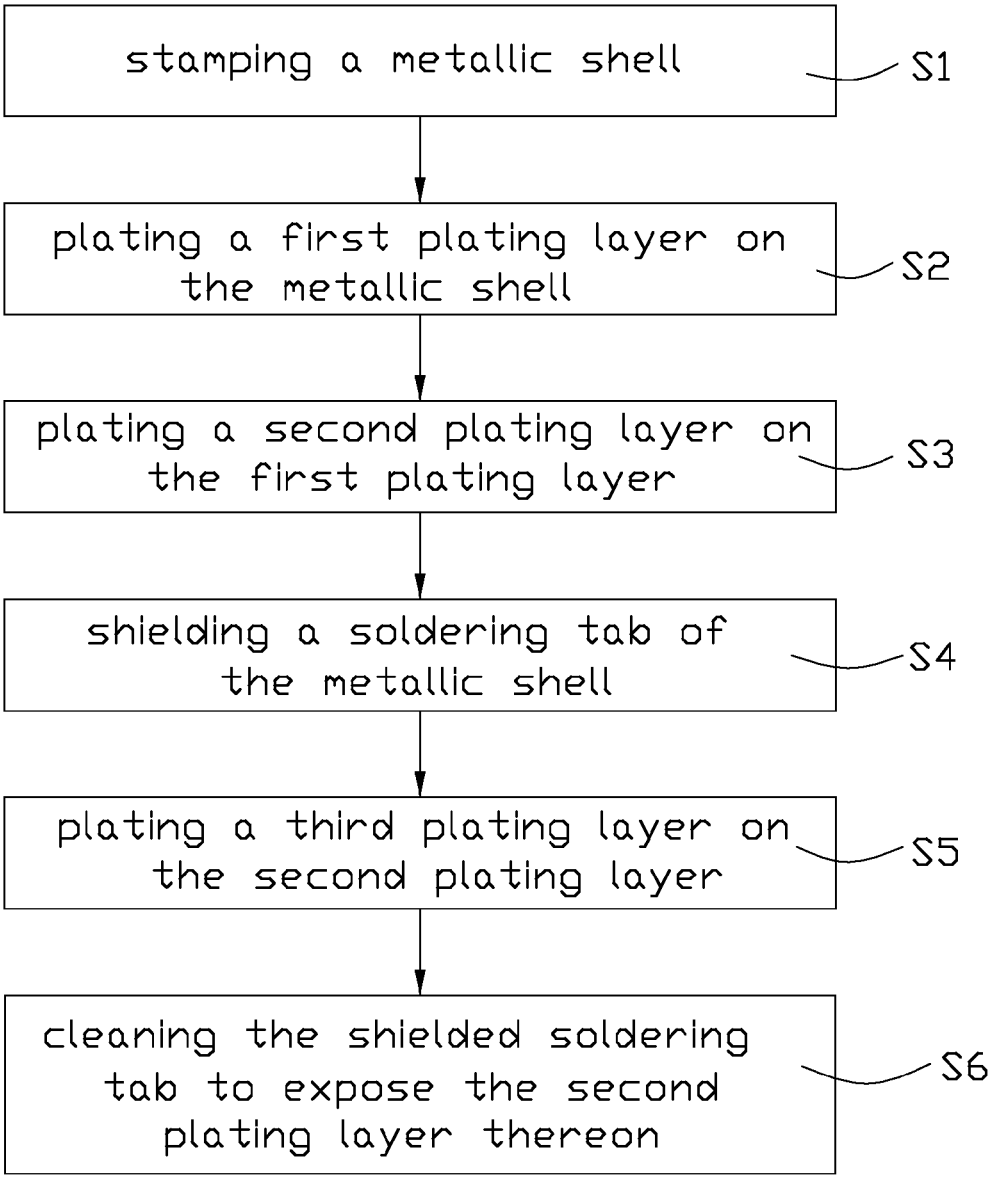
FIG. 11 is a flow chart showing a method for surface treatment of the metallic shell.

Referring to FIG. 10, each of the peripheral walls, the extending portions 14 and the soldering tabs 15 includes an intermediate layer 20 made of a first material (such as iron or stainless steel), a first plating layer 21 covering both inner and outer sides of the intermediate layer 20, a second plating layer 22 covering both inner and outer sides of the first plating layer 21, and a third plating layer 23 covering both inner and outer sides of the second plating layer 21 of the peripheral walls and the extending portions 14. The foregoing-mentioned "inner and outer sides" are "top and bottom sides" of the illustrated embodiment of the present disclosure. The first plating layer 21 is made of a second material which is a nickel alloy of the illustrated embodiment. The second plating layer 22 is made of a third material which is gold or tin of the illustrated embodiment. The third plating layer 23 is made of a fourth material which is black titanium or black nickel of the illustrated embodiment.

The first plating layer 21 coated on the intermediate layer 20 is for providing a suitable substrate for easily coating the subsequent second plating layer 22. The second plating layer 22, on one hand, improves the soldering capability of the soldering tabs 15, and on the other hand, improves the integral conductive capability of the metallic shell 1. The third plating layer 23, on one hand, presents the metallic shell 1 of black color so as to keep it in accord with the color of the electronic device, and on the other hand, improves the anti-wear capability of the metallic shell 1. The "back color" includes matted black.

It is noted that the third plating layer 23 is uncoated on the second plating layer 22 of the soldering tabs 15 in order to prevent that the third plating layer 23 weakening the soldering capability of the soldering tabs 15.

When the electronic devices are of back colors, through the structure of the metallic shell 1 of the present invention, the metallic shell 1 not only has robust conductive capability, robust soldering capability and robust anti-wear capability, but also the color of the metallic shell 1 can be in accord with the color of the electronic devices.

Referring to FIGS. 3 to 11, the present invention discloses a method for surface treatment of a metallic shell 1 of an electrical connector 100. The method includes the steps of:

S1) providing a metallic shell 1 stamped from a first material, the metallic shell 1 being provided with a plurality of peripheral walls and at least one soldering tab 15 extending from one of the peripheral walls to be soldered to a circuit board;

S2) plating a first plating layer 21 of a second material on both inner and outer sides of the soldering tab 15 and the peripheral walls;

S3) plating a second plating layer 22 of a third material on both inner and outer sides of the first plating layer 21 of the soldering tab 15 and the peripheral walls, the third material being of robust soldering capability;

S4) shielding the soldering tab 15 so as to be uncoated in subsequent steps;

S5) plating a third plating layer 23 of a fourth material on both inner and outer sides of the second plating layer 22 of the peripheral walls, the fourth material being of robust anti-wear capability; and S6) cleaning the foregoing shielded soldering tab 15 to expose the second plating layer 22 thereon.

In the step S2), the second material of the first plating layer 21 is nickel alloy. In the step S3), the third material of the second plating layer 22 is gold or tin. In the step S5), the fourth material of the third plating layer 23 is black titanium or black nickel, and the third plating layer 23 is fabricated by Physical Vapor Deposition (PVD) vacuum plating technology. Because the process temperature of the PVD vacuum plating technology is high (near 400° C.), it requires the third material of the second plating layer 22 has high temperature resistance. According to the preferred embodiment of the present invention, under this processing method, gold is selected as the third material of the second plating layer 22. However, in other embodiments, the third plating layer 23 can be fabricated by chemical plating technology. Because the process temperature of the chemical plating technology is usually low, under this condition, either gold or tin can be selected as the suitable material of the second plating layer 22.

In the step S4), the soldering tab 15 is coated by a protective sleeve or is adhibited by a protective membrane. Correspondingly, the step S6) includes removing the protective sleeve or the protective membrane. However, in alternative embodiments, in the step S4), the soldering tab 15 can be protected by a kind of lipid. Correspondingly, the step S6) includes removing the kind of lipid.

It is to be understood, however, that even though numerous, characteristics and advantages of the present disclosure have been set forth in the foregoing description, together with details of the structure and function of the invention, the disclosed is illustrative only, and changes may be made in detail, especially in matters of number, shape, size, and arrangement of parts within the principles of the invention to the full extent indicated by the broadest general meaning of the terms in which the appended claims are expressed.

What is claimed is:

1. An electrical connector comprising:

an insulative housing;

a plurality of contacts retained in the insulative housing; and a metallic shell enclosing the insulative housing, the metallic shell comprising a plurality of peripheral walls jointly forming a receiving cavity and a soldering tab extending from one of the peripheral walls to be soldered to a circuit board; wherein each of the soldering tab and the peripheral walls comprises an intermediate layer made of a first material, a first plating layer made of a second material, a second plating layer made of a third material and a third plating layer made of a fourth material, the third material being of robust soldering capability and the fourth material being of robust anti-wear capability; and wherein (i) the first plating layer covers both inner and outer sides of the intermediate layer of the soldering tab and the peripheral walls;

(ii) the second plating layer covers both inner and outer sides of the first plating layer of the soldering tab and the peripheral walls; and (iii) the third plating layer covers both inner and outer sides of the second plating layer of the peripheral walls for enhancing anti-wear properties while leaving the second plating layer of the soldering tab uncoated for wetting.

2. The electrical connector as claimed in claim 1, wherein the electrical connector is a standard Micro USB connector.

3. The electrical connector as claimed in claim 1, wherein the second material of the first plating layer is a nickel alloy.

4. The electrical connector as claimed in claim 1, wherein the third material of the second plating layer is gold or tin.

5. The electrical connector as claimed in claim 1, wherein the fourth material of the third plating layer is black titanium or black nickel.

6. The electrical connector as claimed in claim 1, wherein the soldering tab extends along a vertical direction for being inserted through the circuit board before getting soldered.

7. A method for surface treatment of a metallic shell of an electrical connector, comprising the steps of:

S1) providing a metallic shell stamped from a first material, the metallic shell being provided with a plurality of peripheral walls and a soldering tab extending from one of the peripheral walls to be soldered to a circuit board;

S2) plating a first plating layer of a second material on both inner and outer sides of the soldering tab and the peripheral walls;

S3) plating a second plating layer of a third material on both inner and outer sides of the first plating layer of the soldering tab and the peripheral walls, the third material being of robust soldering capability;

S4) shielding the soldering tab so as to be uncoated in subsequent steps;

S5) plating a third plating layer of a fourth material on both inner and outer sides of the second plating layer of the peripheral walls, the fourth material being of robust anti-wear capability; and S6) cleaning the foregoing shielded soldering tab to expose the second plating layer thereon.

8. The method as claimed in claim 7, wherein in the step S2), the second material of the first plating layer is a nickel alloy.

9. The method as claimed in claim 7, wherein in the step S3), the third material of the second plating layer is gold or tin.

10. The method as claimed in claim 7, wherein in the step S3), the third material of the second plating layer is gold; and wherein in the step S5), the fourth material of the third plating layer is black titanium or black nickel, and the third plating layer is fabricated by Physical Vapor Deposition vacuum plating technology.

11. The method as claimed in claim 9, wherein in the step S5), the fourth material of the third plating layer is black titanium or black nickel, and the third plating layer is fabricated by chemical plating technology.

12. The method as claimed in claim 7, wherein in the step S4), the soldering tab is coated by a protective sleeve or is adhibited by a protective membrane.

13. The method as claimed in claim 12, wherein the step S6) comprises removing the protective sleeve or the protective membrane.

14. The method as claimed in claim 7, wherein in the step S4), the soldering tab is protected by a kind of lipid.

15. The method as claimed in claim 14, wherein the step S6) comprises removing the kind of lipid.

16. An electrical connector comprising:

an insulative housing covered by a metal shell;

said metal shell including a top wall with a plurality of soldering tabs for mounting to a printed circuit board, wherein all portions of said metal shell except the soldering tabs include an inner nickel layer, a middle gold or tin layer and a black titanium layer successively via three steps of respectively applying the corresponding layers, under condition that the soldering tabs lack the black titanium by applying protective membrane thereon before the step of applying the black titanium layer to the whole metal shell and by cleaning or removing the protective membrane on the soldering tab after the step of applying the black titanium to the whole metal shell.

17. The electrical connector as claimed in claim 16, wherein the soldering tabs vertically extend perpendicular to said top wall.

* * * * *